US005257908A

United States Patent [19]

Ortolano

[11] Patent Number: 5,257,908

[45] Date of Patent: Nov. 2, 1993

[54] TURBINE LASHING STRUCTURE

[76] Inventor: Ralph J. Ortolano, 3776 Coolheights Dr., Rancho Palos Verdes, Calif. 90274

[21] Appl. No.: 792,962

[22] Filed: Nov. 15, 1991

[51] Int. Cl.[5] ..... F01D 5/22

[52] U.S. Cl. ..... 416/190; 416/191; 416/193 R; 416/196 R

[58] Field of Search ..... 416/190, 191, 192, 193 R, 416/194, 195, 196 R, 500

[56] References Cited

U.S. PATENT DOCUMENTS

| | | | |
|---|---|---|---|
| Re. 32,737 | 8/1988 | Ortolano . | |
| 3,479,009 | 11/1969 | Bean | 416/193 R |
| 3,588,278 | 6/1971 | Ortolano et al. . | |
| 3,606,578 | 9/1971 | Ortolano . | |
| 3,702,221 | 11/1972 | Ortolano . | |
| 4,076,455 | 2/1978 | Stargardter | 416/500 |
| 4,386,887 | 6/1983 | Ortolano . | |
| 4,662,824 | 5/1987 | Ortolano . | |
| 4,710,102 | 12/1987 | Ortolano . | |
| 4,840,539 | 6/1989 | Bourcier et al. | 416/191 |

FOREIGN PATENT DOCUMENTS

| | | | |
|---|---|---|---|
| 0076208 | 5/1982 | Japan | 416/190 |
| 0274597 | 4/1951 | Switzerland | 416/196 |

*Primary Examiner*—Edward K. Look
*Assistant Examiner*—Christopher Verdier
*Attorney, Agent, or Firm*—Charles, Berman Sheldon and Mak

[57] ABSTRACT

Turbine blades are held in groups formed by a series of spaced lugs constituting a lashing structure. Selected lugs have gaps which are "Z"-shaped, the gaps tending to close during untwisting of the blades when the blades are subjected to high centrifugal forces.

20 Claims, 2 Drawing Sheets

TURBINE LASHING STRUCTURE

BACKGROUND

This invention relates to an elastic fluid axial flow turbine or compressor. More particularly, the invention relates to a lashing structure used for the blades for such a turbine or compressor.

An elastic fluid axial flow turbine or compressor comprises a rotor having a peripheral groove and an annular row of blades having root portions disposed in the groove. A variety of blade structures are known and a variety of techniques for minimizing vibratory stresses in the blade structures have been developed.

Lashing lugs are used on longer blades to provide a tying device between blades for vibration control when the centrifugal stress becomes excessive.

A purpose of lashing blades is to reduce the bending moment in the blade and root, to raise the blade frequency in certain modes and to introduce means to tune the blade away from resonance at the running speed. A purpose of long arc lashing or shrouding is to reduce the response to high stressing modes of vibration. The shroud, whether long or short arc, offers additional benefits in acting as a rotating seal, resists strumming, and allows foreign material to pass through the row without extensive damage.

Most lashing lugs are streamlined to minimize flow disturbance which can cause performance loss. Lugs may have short spans and different tying structures such as sleeves to integrate the lug into a lashing structure have been used. Where the span of the lug is short, it is impractical to use sleeves.

Different blade constructions using lugs have been subject to failure problems.

There is the need to provide for flexibly interconnecting blades in lashing structures to minimize stress and to permit for retrofitting existing turbines and compressors.

SUMMARY

By this invention, there is provided means for minimizing disadvantages in the prior art.

According to the invention, a rotor structure includes a rotor spindle and an annular row of blades having tips removed from the spindle. An arcuate series of spaced lugs constitutes a first lashing structure between the spindle and the tips. The selected tips have a gap such that at least one pair of adjacent blades is configured to be flexibly interlocked.

By having a gap located in circumferentially located positions about a lashing structure, a long arc form of lashing structure can be provided to the blades.

The gap preferably has a "Z" configuration comprising two end sections connected by a section substantially parallel to the direction of rotation of the spindle. The two end sections are transverse to the direction of rotation. When the machine is in operation, the blades tend to untwist resulting in the gap closing in the middle section of the "Z" configuration.

Multiple lashing structures can be selectively provided to a row of blades, and the "Z" gap can be circumferentially offset or in line relative to gaps in an adjacent radial structure.

The invention is now further described with reference to the accompanying drawings.

DRAWINGS

DESCRIPTION

The rotor structure for an axial flow elastic fluid utilizing machine in the sense of a turbine substantially reduces axio-torsional modes of vibration by using "Z" cut gaps in spaced lugs of lashing structures between adjacent blades. The "tangential" mode of vibration is the in-phase mode of vibration in the plane of maximum flexibility, approximately perpendicular to the rotational axis of a rotor. The axial mode of vibration is the in-phase vibration approximately in the direction of the axis of the rotor.

Figure 1:
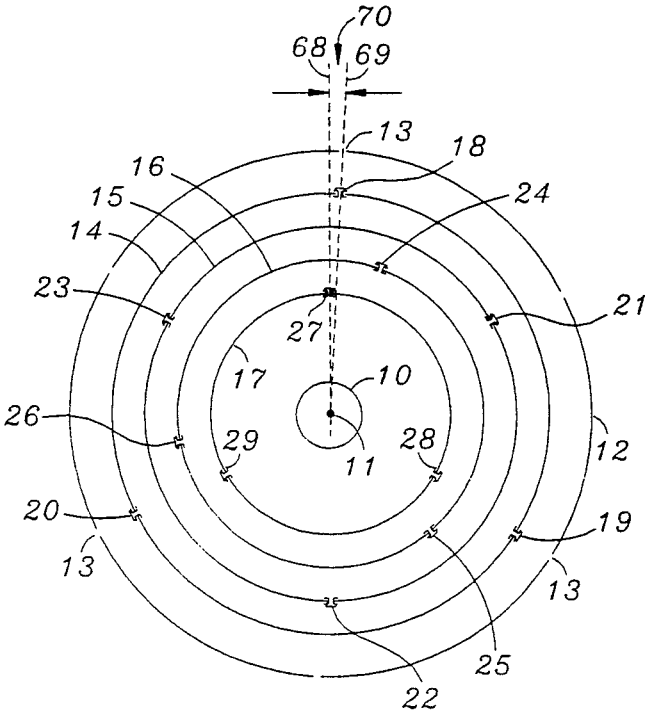
FIG. 1 is a diagrammatic view of a blade structure having multiple radially spaced lashing structures for dividing the blades into long arc groups, the structures being radially offset.

With reference to FIG. 1, there is shown diagrammatically a blade structure. The structure illustrated has a spindle 10 located about an axis of rotation 11. There is also illustrated an outer shroud structure 12 to form arcuate groups of shrouded blades. As indicated, there are three such structures substantially of 120° in extent about the axis 11.

The blades are susceptible to vibrate in a tangential in-phase mode having a resonant frequency at least that of the rated maximum running speed of the rotor. To reduce the tangential mode vibrations, the shroud structure 12 divides the blades into a number equal to the nearest likely resonant frequency tangential divided by an integer multiple (i.e., 1, 2, 3 . . . ) of the rotor running speed. There is a gap 13 between each respective shroud structure which may or may not be connected by a similar "Z"-shaped linked device.

Inwardly located of the shroud structure 12, there are shown four circumferential lashing structures 14, 15, 16 and 17, respectively. Structure 14 is the outer structure and structure 17 is the innermost lashing structure. Each of the lashing structures has three selected gaps, 18, 19 and 20, circumferentially spaced in structure 14. Gaps 21, 22, 23 are in structure 15. Gaps 24, 25 and 26 are in the next innermost structure 16. Gaps 27, 28 and 29 are in the innermost structure 17. Each of these selective gaps 18, 19 and 20 in the lashing structures 14 is configured so that they are located between adjacent pairs of blades so as to provide a flexible interlock between adjacent blades.

Figure 2:
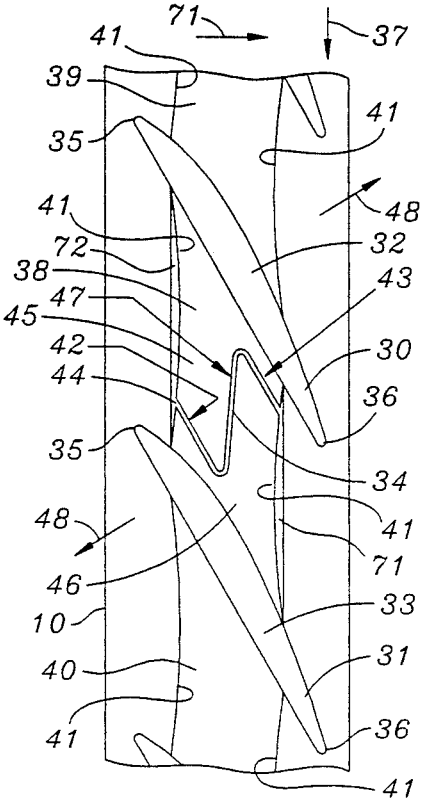
FIG. 2 is a plan view of adjacent end blades illustrating lugs between adjacent blades and a gap between two adjacent blades, wherein the gap is formed by a "Z" cut.

As illustrated in FIG. 2, blades 30 and 31 have ends 32 and 33, respectively. Between blades 30 and 31, there is located the gap 34, the gap having a "Z" configuration. Blades 30 and 31 have the usual air foil contour with a leading edge 35 and a trailing edge 36. In some cases, the tips 32 and 33 may be connected with an outer shroud 12 and are held in place by tenon rivets in the usual manner. Steam flow in FIG. 2 is illustrated by arrow 71, namely, from left to right. The resulting direction of rotation of the blades 32 and 33 is indicated by arrow 37.

The lug elements 38, 39 and 40 are located between adjacent blades. The elements 38, 39 and 40 have concave faces 41 which facilitate steam flow through the blades with a minimum of interference.

Lug 38 has the gap 34 wherein the circumferentially adjacent lugs 39 and 40 do not have gap 34.

Lug 38 has an admission side diagonal end 42 and a discharge side diagonal end 43, the ends 42 and 43 of the adjacent pair of element constituting the lug 38 being separated by a gap 44. The adjoining ends of the adjacent segments 45 and 46 are configured to be flexibly interlocked to each other without connectors. This is accomplished by having each adjacent end include a web section 47, referred to as the middle section. This is substantially parallel to the direction of rotation of the blades, namely, substantially perpendicular to the rotational axis of the rotor.

As shown in FIG. 2, the ends 42 and 43, together with a middle web section 47, have a "Z" configuration. As such, there is formed in two segments 45 and 46, two end sections 42 and 43 transverse to the direction of rotation of the blades and connected by the middle section 47. The end sections 42 and 43 are curved, although they can be straight. The middle section 47 of the gap 44 extends substantially between the blades 32 and 33 along the direction of rotation, and constitutes at least the greater part of spacing between adjacent blades 30 and 31. The gap 34 between the sections is only about 40 to 120 mils wide to be sure that the gap just closes in use. The actual size of the gap is dependent on the amount of untwisting which occurs in the blading when the rotor is at its normal operating speed. Preferably the ends of the middle section have radii which may be assured by drilling holes at those locations, or by other means.

In operation of the turbine, the gap 44 between the diagonal ends 42 and 43 opens due to centrifugal growth. The blades 32 and 33 tend to untwist due to centrifugal forces induced by rotating them with the groups tending to rotate as shown by arrows 48 in FIG. 2, thereby closing as least the middle section 47 of the gap 34. This produces a substantially continuous interlocking lashing structure that results in significant vibration damping, which cooperates with the blade grouping, to minimize vibration of the blades and yet provide sufficient flexibility to allow for thermal and centrifugal expansion of the rotor.

The use of the flexible "Z" cut interlocking lashing structure segments provides advantages. In effect, a continuous tie is formed of the lashing structure and this ensures that both tangential, axial, torsional and "U" modes of operation are substantially suppressed. Also, the higher axio-torsional modes are limited to continuous tie amplitudes. The design ensures that the rotor has the capability to adjust for centrifugal and thermal distortion without excessive stress. Moreover, these objectives are accomplished without the need for additional connecting elements and may be introduced into existing short arc structures without the replacement of sound parts.

Figure 3:
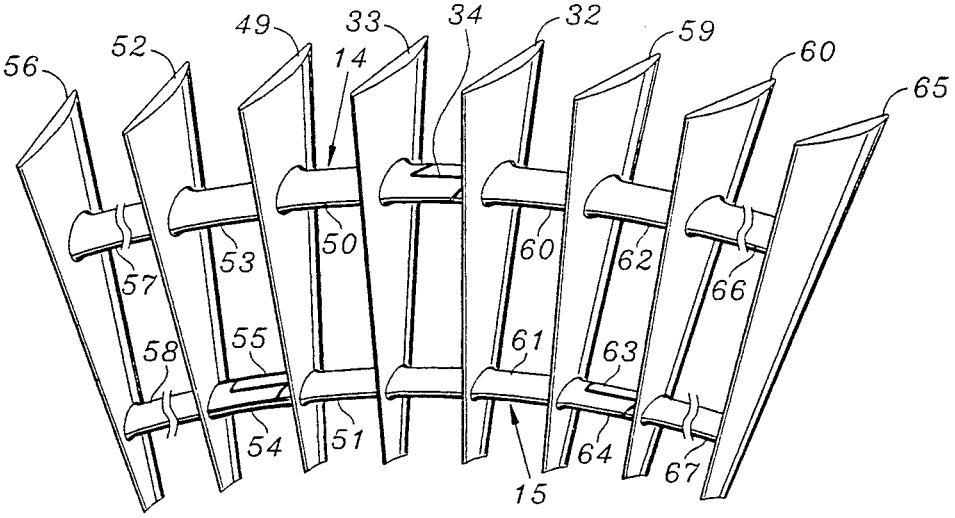
FIG. 3 is a perspective view illustrating adjacent blades with lug structures located between adjacent blades to form lashing structures. There are two radially spaced lashing structures with the "Z" cut in each lashing structure being radially offset from the "Z" cut in adjacent lashing structures.

As illustrated in FIG. 3, a portion of a blade rotor is shown with the lashing structure 14 being the outermost lashing configuration and there being an inner configuration 15. The "Z" gap 34 is illustrated between blades 32 and 33. Between blades 33 and 49, there are two lashing lugs 50 in the lashing structure 14 and 51 in the lashing structure 15. Lashing lugs 50 and 51 do not have a gap. Between blades 49 and 52, lashing structure 53 does not have a gap whereas lashing lug 54 has a "Z" gap 55. Progressively to blade 56, there is a lug 57 and 58 which will not have gaps. In the clockwise sense between blades 32 and 59, lugs 60 and 61 does not have a "Z" cut. Between blades 59 and 60, lug 62 does not have a cut whereas lug 63 has a cut 64. Between blades 60 and 65, there is no gap in lug 66 and lug 67.

Figure 4:
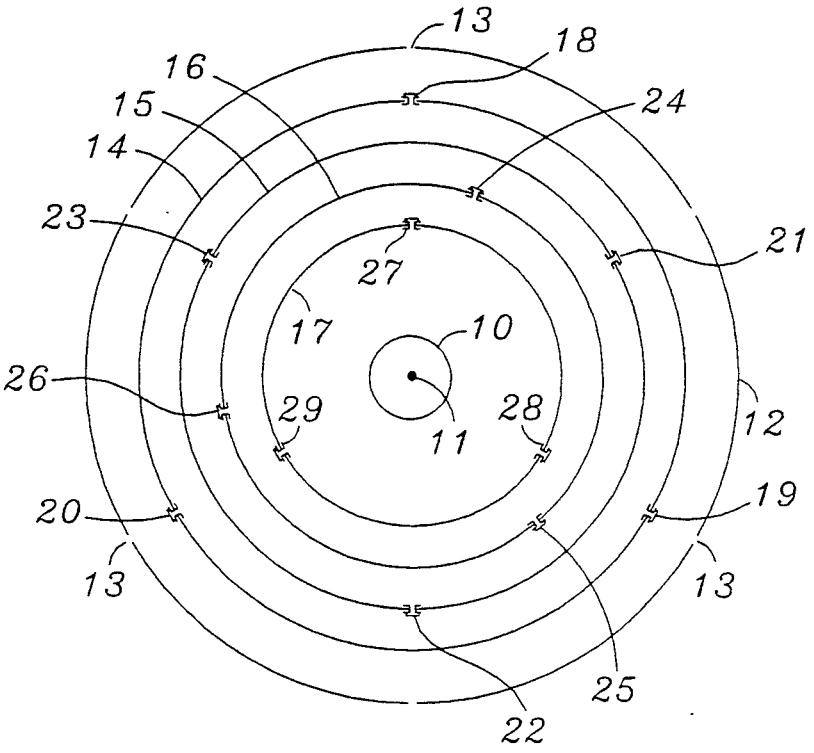
FIG. 4 is a representation of FIG. 1 where the different lashing structures are partly coincident, namely, not radially offset relative to each other.

As illustrated in FIG. 1, the spacing between a gap 18 in the lashing structure 14 and a gap 27 in the lashing structure 17 is readily offset by one or more blade locations. This is depicted between the radial lines 68 and 69 and is shown by the gap 70. In most structures employing two lacing elements such as a shroud and one wire or two wires, the gaps in the inner element will be placed at the center of the outer element span to derive maximum vibration attenuation benefit. Where three or more lacing elements are used, the gaps will usually be staggered to avoid placing excessive untwisting stress on any element. To this end, lugs located above or below a "Z" cut will, where practical, be enlarged to assure acceptably low stresses. In FIG. 4, the arrangement is illustrated where the lashing structures are coincident in part. In different situations, some or all of the lashing structures are coincident.

In the lug which has a "Z" cut 34, there is provided a weld buildup on the concave faces 41 of the lug, the weld buildup being directed in line with the middle section 47 of the "Z" cut. The weld buildup produces an adequate section at the base of the web. "Z" cuts can be produced using an angle drill, a cut-off wheel about 4" in diameter and a small cut-off wheel attached to a driver. Since the number of "Z" cuts is relatively small, about 2 to 8 per blade row, producing the "Z" cuts by hand is practical. In large volume production, they can be produced by more sophisticated means. The ability to locally increase the strength of the lugs equipped with "Z" cuts is also attractive and permits for effective retrofitting of lugs on blades. The buildup ensures that the cross-section of the lug at the base of the "Z" cut is approximately the same as originally existed in a typical lug. The buildup may be provided in lugs in outer lashing structures, for instance, structure 14, but not in an inner structure, for instance, 15, 16 or 17.

The blade groups may have only a single circumferential lashing structure 14 or a multiple number as required by the blade configuration for the turbine. The blades may form groups of 12 or more and as such form a long arc structure.

The buildup may be provided on some lugs in a lashing structure but not on others. The centrifugal untwisting of a blade, and the axial bending load on the lugs above or below a "Z" cut lug is likely to increase due to the untwisting effect of the "Z" cut lug not being sufficiently highly resisted. The result is that the continuous lugs above or below a "Z" cut lug should be increased in cross-section by the buildup to be about the same axial section modulus as the total of the lugs resisting twisting at the continuous tie locations. It is therefore necessary to effect the buildup both on lugs on an inner and outer lashing structure at these locations.

An advantage of the invention is that it can be used easily in a retrofit with existing structures. As a first step, existing gaps in the lashing structure of existing blades are welded together to create the proper long arc. Then those lugs which will be located above or below "Z" cuts are enlarged. Finally, lugs which are converted into "Z" cuts are enlarged and the "Z" cut made before proceeding to the next "Z" cut lug. When all "Z" cuts have been made, the web gaps 34 are dressed to the required opening and the radii at the base of the web gaps are rounded and polished.

As an alternative to the cut-off wheel, it is possible to form the "Z" cuts with electrostatic discharge machines (EDM).

Many other forms of the invention exist, each differing from the other in matters of detail only. The scope of the invention is to be determined in accordance with the spirit and scope of the following claims.

I claim:

1. A rotor structure for an axial flow elastic fluid utilizing machine comprising:

(a) a rotor spindle;

(b) an annular row of radially extending blades carried by the rotor spindle, the blades having tips removed from the spindle;

(c) a series of spaced lugs for constituting a first lashing structure between the blades, the lugs being located at a radial distance removed from the spindle and removed from the tips, the lugs being bonded to the blades for connecting the blades to each other in groups, and selected lugs having a gap such that at least one pair of adjacent blades are configured to be flexibly interlocked, and (d) wherein the row of blades includes multiple lashing structures, the lashing structures being spaced radially apart and being located removed from the blade tips and removed from the rotor spindle, each lashing structure having selected gaps between lugs therein, the gaps between the blades of the different lashing structures being coincident to each other circumferentially.

2. A structure as claimed in claim 1 wherein the gap has a "Z" configuration comprising two end sections connected by a section substantially parallel to the direction of rotation of the spindle, the two end sections being transverse to the direction of rotation of the spindle such that when the machine is in operation, the blades tend to untwist, resulting in the gap closing in a middle section of the "Z" configuration.

3. The rotor structure of claim 2 in which adjoining ends of gaps have the "Z" configuration.

4. The rotor structure of claim 1 wherein the gap is formed such that the segments of lugs to either side of the gap are separated from each other by about 40 to about 120 mils at zero speed and are in contact at the running speed.

5. The rotor structure of claim 2 wherein the gap is formed such that the segments of lugs to either side of the gap are separated from each other by about 40 to about 120 mils at zero speed and are contacting at running speed.

6. The rotor structure of claim 2 in which the section substantially parallel to the rotation of the spindle constitutes at least the greater part of spacing between adjacent blades.

7. The rotor structure of claim 2 in which the "Z" configuration consists of three sections, said sections being the two end sections and the section substantially parallel to the direction of rotation of the spindle.

8. The rotor structure of claim 1 wherein for a lug having a gap, there is included a build up of solid material.

9. The rotor structure of claim 1 including lugs without gaps and lugs with gaps located radially above each other.

10. A rotor structure for an axial flow elastic fluid utilizing machine comprising:

(a) a rotor spindle;

(b) an annular row of radially extending blades carried by the rotor spindle, the blades having tips removed from the spindle; and (c) a series of spaced lugs for constituting multiple lashing structures between the blades, the lashing structures being spaced radially apart and being located removed from the blade tips and removed from the rotor spindle, each lashing structure having selected gaps between lugs therein, the gaps between the blades of the different lashing structures being coincident or offset to each other circumferentially the lugs being bonded to the blades for connecting the blades to each other in groups, and selected lugs having a gap such that at least one pair of adjacent blades are configured to be flexibly interlocked, and wherein the blades form an arc such that there are at least about 12 blades between "Z" cuts formed in the lugs spaced circumferentially about the rotor spindle.

11. A rotor as claimed in claim 10 wherein about the circumference of the spindle there are between about 3 to 9 lugs having gaps.

12. A structure as claimed in claim 11 wherein the "Z" cuts comprise two end sections connected by a section substantially parallel to the direction of rotation of the spindle, the two end sections being traverse to the direction of rotation of the spindle such that when the machine is in operation, the blades tend to untwist, resulting in the gap closing in a middle section of the "Z" cuts.

13. A rotor structure for an axial flow elastic fluid utilizing machine comprising:

(a) a rotor spindle;

(b) an annular row of radially extending blades carried by the rotor spindle, the blades having tips removed from the spindle;

(c) a series of spaced lugs for constituting a first lashing structure between the blades, the lugs being located at a radial distance removed from the spindle and removed from the tips, the lugs being bonded to the blades for connecting the blades to each other in groups, and selected lugs having a gap such that at least one pair of adjacent blades are configured to be flexibly interlocked, and (d) wherein the row of blades includes multiple lashing structures, the lashing structures being spaced radially apart and being located removed from the blade tips and removed from the rotor spindle, each lashing structure having selected gaps between lugs therein, the gaps between the blades of the different lashing structures being offset from each other circumferentially.

14. The rotor structure of claim 1 including lugs without gaps and lugs, with gaps located below each other.

15. A rotor structure for an axial flow elastic fluid utilizing machine comprising:

(a) a rotor spindle;

(b) an annular row of radially extending blades carried by the rotor spindle, the blades having tips removed from the spindle;

(c) a series of spaced lugs for constituting a first lashing structure between the blades, the lugs being located at a radial distance removed from the spindle and removed from the tips, the lugs being bonded to the blades for connecting the blades to each other in groups, and selected lugs having a gap such that at least one pair of adjacent blades are configured to be flexibly interlocked; and (d) for a lug having a gap there is included a build up of solid material on the lug.

16. A structure as claimed in claim 15 wherein the gap has a "Z" configuration comprising two end sections connected by a section substantially parallel to the direction of rotation of the spindle, the two end sections being transverse to the direction of rotation of the spindle such that when the machine is in operation, the blades tend to untwist, resulting in the gap closing in a middle section of the "Z" configuration.

17. The rotor structure of claim 16 in which adjoining ends of gaps have the "Z" configuration.

18. The rotor structure of claim 16 in which the section substantially parallel to the rotation of the spindle constitutes at least the greater part of spacing between adjacent blades.

19. The rotor structure of claim 15 including lugs without gaps and lugs with gaps located radially above each other.

20. The rotor structure of claim 15 including lugs without gaps and lugs, with gaps located below each other.

* * * * *